US012029968B1

(12) United States Patent
Woodrow

(10) Patent No.: US 12,029,968 B1
(45) Date of Patent: Jul. 9, 2024

(54) BEER PONG TABLE

(71) Applicant: David Lee Woodrow, Mary Esther, FL (US)

(72) Inventor: David Lee Woodrow, Mary Esther, FL (US)

( * ) Notice: Subject to any disclaimer, the term of this patent is extended or adjusted under 35 U.S.C. 154(b) by 0 days.

(21) Appl. No.: 17/402,555

(22) Filed: Aug. 15, 2021

(51) Int. Cl.
*A63D 15/00* (2006.01)
*A63D 15/08* (2006.01)

(52) U.S. Cl.
CPC ..... *A63D 15/003* (2013.01); *A63D 15/005* (2013.01); *A63D 15/08* (2013.01)

(58) Field of Classification Search
CPC ..... A63D 15/003; A63D 15/005
USPC ..... 473/20
See application file for complete search history.

(56) References Cited

U.S. PATENT DOCUMENTS 5,413,344 A * 5/1995 Darden ..... A63B 67/02 473/158
7,325,807 B1 * 2/2008 Eason ..... A63B 67/002 273/342
8,176,745 B1 * 5/2012 Korza ..... F25D 31/008 62/258
10,307,664 B1 * 6/2019 Villela ..... A63F 3/00003
2006/0226606 A1 * 10/2006 Finley ..... A63B 67/002 273/342
2012/0013073 A1 * 1/2012 Wyland ..... A63B 67/066 273/287
2012/0190415 A1 * 7/2012 Gardner ..... A63D 15/00 463/2
2014/0213380 A1 * 7/2014 Haase ..... A63D 15/04 473/20
2018/0093170 A1 * 4/2018 Dahl ..... A63B 69/40

* cited by examiner

*Primary Examiner* — Mitra Aryanpour
(74) *Attorney, Agent, or Firm* — Peter Loffler

(57) ABSTRACT

A game table for playing a variant of beer pong uses a playing surface that has a series of openings at either end in the traditional triangular pattern. A ball is rolled from one end toward the other with the goal of sinking the ball into one of the openings. When a ball is so sunk, that hole is plugged, the plug used having a handle that extends above the playing surface creating an obstacle for the ball. A cue that be used the hit the ball. Additional balls can be used so the one ball is the shooting ball and the remainder being shot balls. The outer periphery of the playing surface has a raised wall for shot banking. Gutters can be located at either end of the playing surface.

12 Claims, 3 Drawing Sheets

BEER PONG TABLE

BACKGROUND OF THE INVENTION

1. Field of the Invention

The present invention relates to a table that has a series of openings on either end, set up in a triangular formation wherein players on each side attempt to sink a ball into one of the openings on an opposing end of the table in similar fashion to the game of beer pong.

2. Background of the Prior Art

Beer pong, also known as Beirut, is a widely popular drinking game played on college campuses all across this country. A series of plastic cups are set up on each end of a table in a triangular formation, typically six or ten cups being used. Two teams are formed with each team setting up at the end of the table immediately behind the cups on their end of the table. Each team, in turn, attempts to throw a ping pong ball, either directly or via a bounce off the table, into one of the cups on the opposing team's side of the table. If the team is successful in landing the ping pong ball into a cup on the opposing team's side, the opposing team must drink the contents, typically beer, of that cup and then take the cup out of play. The first team to eliminate the cups on the opposite side of the table is the winner. There are countless variations on the basic rules of beer pong.

A bar would seem like an ideal place to play beer pong. A fun festive atmosphere with plenty of beer available to fill the cups as needed. However, playing traditional beer pong in a bar is not realistic. The use of a ping pong ball during beer pong play means that the ball bounces about on missed shots, often landing relatively far from the beer pong table. In a crowded bar this becomes problematic as the players are chasing the ball through the crowd bumping into people along the way, possibly spilling their drinks. If the bar is particularly crowded, a large supply of ping pong balls would be needed as the balls will get stepped on with regular frequency.

What is needed is a game system that simulates the traditional game of beer pong that can be easily played in a crowded room such as a bar or pub. Such a game must allow for relatively aggressive play by the players while reducing the potential for a player to have to chase down a playing piece through the crowded bar. Ideally, such a game system is relatively simple in concept and game play.

SUMMARY OF THE INVENTION

The beer pong table of the present invention addresses the aforementioned needs in the art by providing a game playing table that simulates the game of beer pong without the need for frequent chasing of a game piece through a crowded bar. Aggressive play on the beer pong table does not typically require a player to chase a game piece through the bar. The beer pong table, is relatively easy to use by players and allows for a large number of variations of the game upon the table. The beer pong table is of relatively simple design and construction, being produced using standard manufacturing techniques, so as to be relatively inexpensive to produce and thus economically attractive to potential consumers for this type of game system. The beer pong table is easy to set up and maintain.

The beer pong table of the present invention is comprised of a game table that has a first end and an opposing second end joined by a first side and an opposing second side. The game table has a playing surface. A series of first openings is disposed within the playing surface proximate the first end, the series of first openings is arranged in a triangular pattern. A series of second openings is disposed within the playing surface proximate the second end, the second openings is arranged in the triangular pattern. A series of plugs is provided such that each plug is receivable within a respective one of the first openings or second openings. Each plug comprising a base that is received within its respective first opening or second opening and a handle that extends above the playing surface whenever the plug is received within its respective first opening or second opening. A first ball is provided and is rolled upon the playing surface. The ball is dimensioned to fit within each of the first openings and each of the second openings. The playing surface is symmetrical about the midline longitudinal axis passing through the playing surface and the playing surface is symmetrical about the midline latitudinal axis passing through the playing surface. A first gutter is located between the first openings and the first end while a second gutter is located between the second opening and the second end. An outer periphery of the playing surface has a raised side wall for bank shots. A cue is provided and is used to the propel the first ball. A series of second balls can be provided which can roll upon the playing surface, being propelled by being struck by the first ball. A rack may be provided for racking the second balls upon the playing surface.

BRIEF DESCRIPTION OF THE DRAWINGS

Similar reference numerals refer to similar parts throughout the several views of the drawings.

DESCRIPTION OF THE PREFERRED EMBODIMENT

Figure 1:
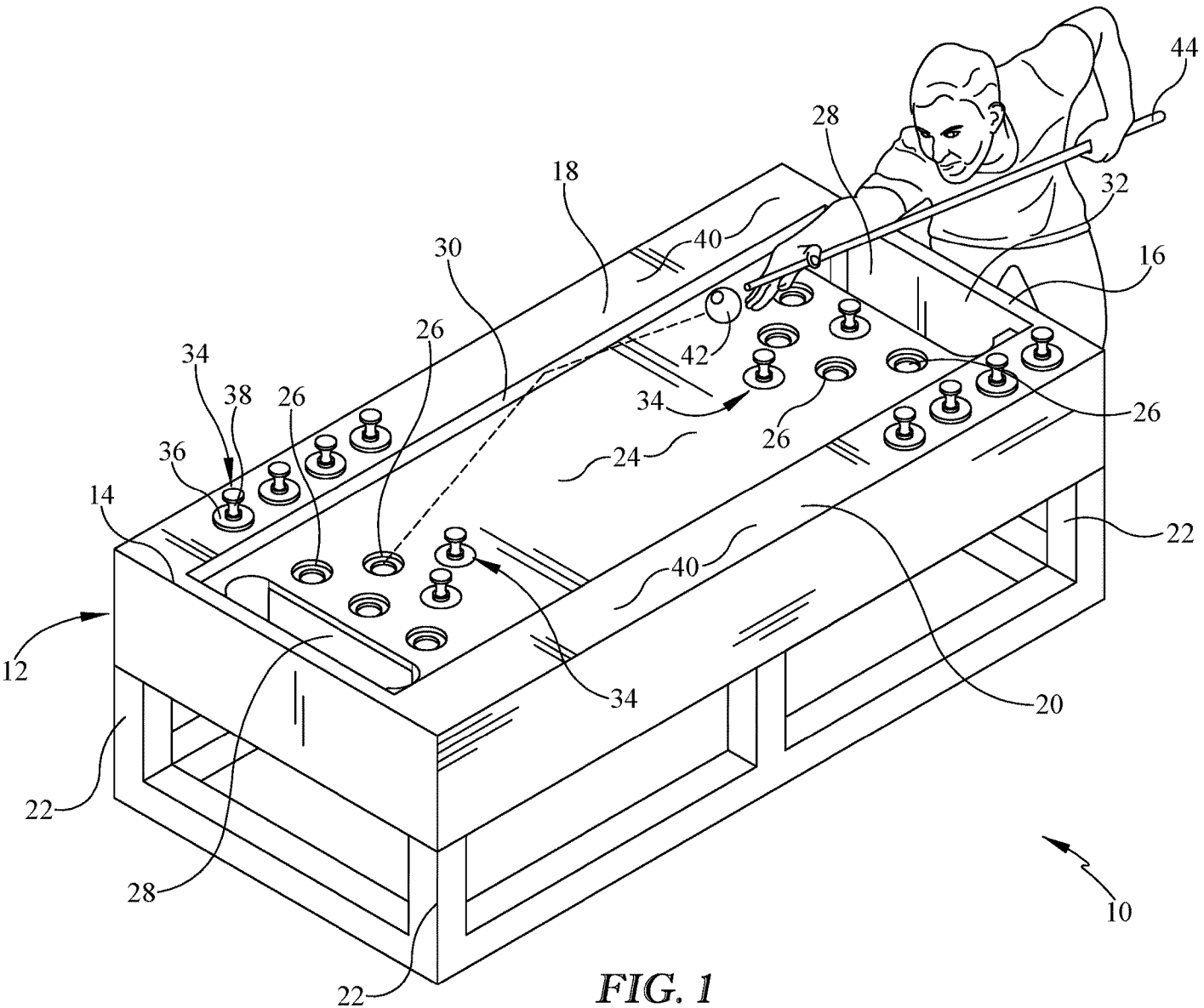
FIG. 1 is an environmental view of the beer pong table of the present invention.
Figure 2:
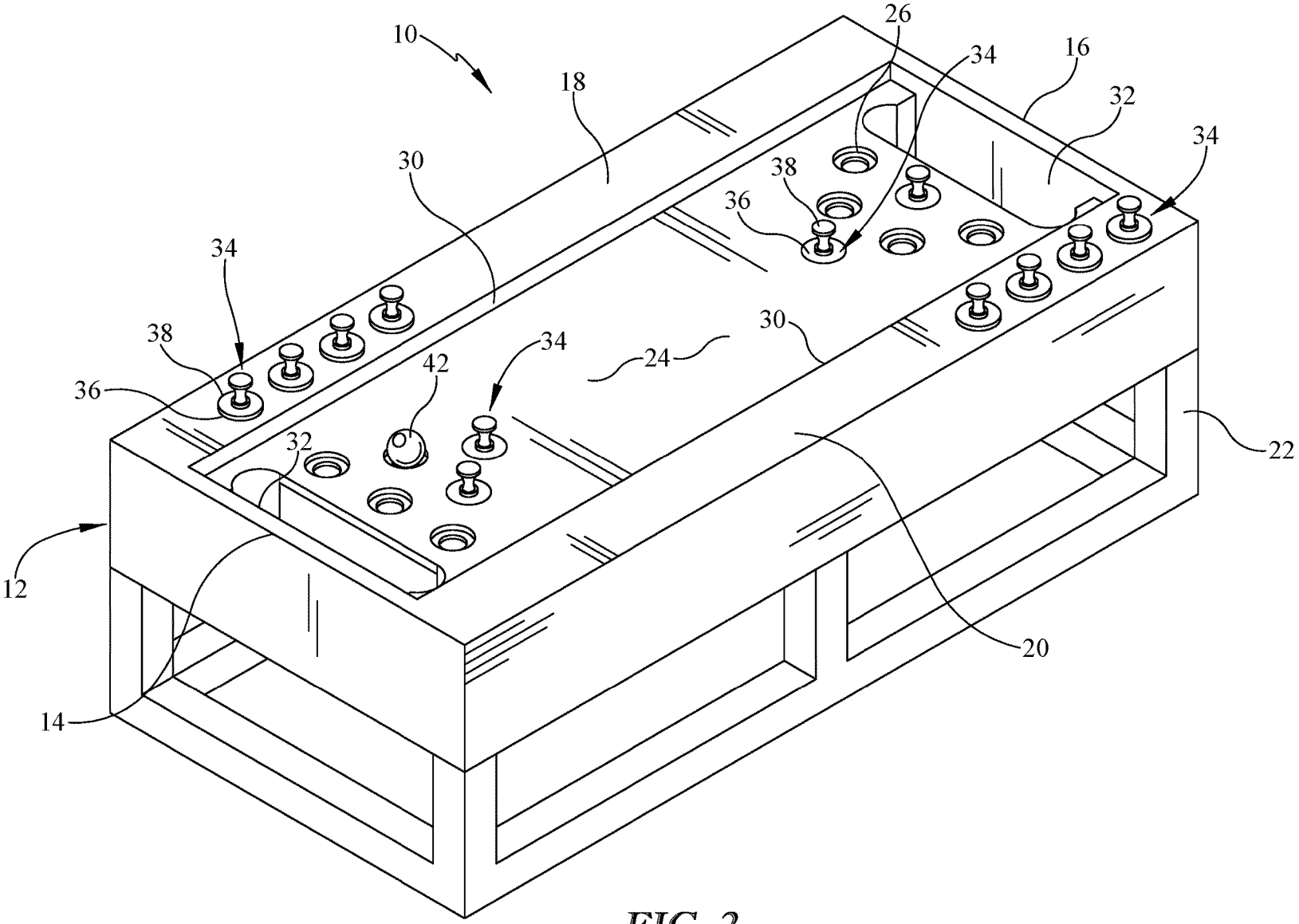
FIG. 2 is a perspective view of the beer pong table.
Figure 3:
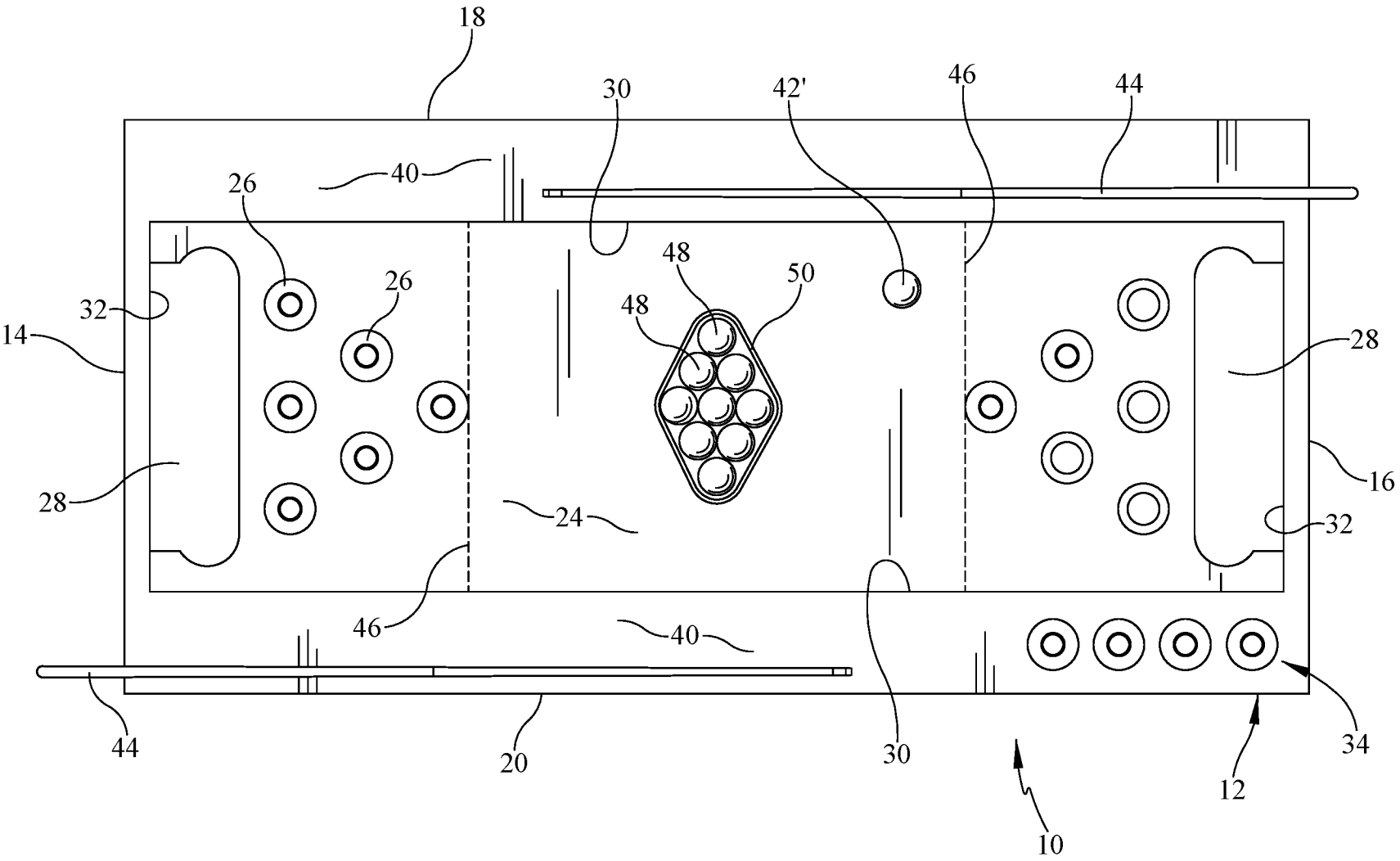
FIG. 3 is a plan view of the beer pong table.

Referring now to the drawings, it is seen that the beer pong table of the present invention, generally denoted by reference numeral 10, is comprised of an elongate, relatively narrow game table 12 having a first end 14 and an opposing second end 16 joined by a first side 18 and an opposing second side 20. Appropriate legs 22 or other supports keep the game table 12 off of the ground surface, although the game table can be constructed without such supports and itself be placed onto another support surface such as a bar top or other table.

As seen, the game table 12 has a playing surface 24 that is substantially flat. Located proximate to each end of the playing surface 24 is a series of openings 26 that are formed in a triangular pattern. The number of openings 26 is dependent on the size of the game table 12 so that a relatively narrow game table may only have three openings, a relatively wider game table 12 may have six openings 26 as shown and an even more wide game table may have ten or even fifteen openings, each row of openings added has one more opening relative to the previous row of openings. Located behind each series of openings 26 is an optional gutter 28. The side walls 30 and the end walls 32 of the game table 12 are raised above the playing surface 24.

A series of plugs 34 are provided such that the base 36 of each plug 34 is dimensioned to snugly fit within one of the openings 26 with the handle 38 of the plug 34 extending above the playing surface 24 when the base 36 of the plug 34 is received within an opening 26. The number of plugs 34 provided is equal to (or possibly two less) than the overall number of openings 26 provided. The plugs 34 can be placed on the shoulder 40 of the game table 12 when not placed into an opening 26.

As seen, the playing surface 24 of the game table is symmetrical about both the midline longitudinal axis passing through the playing surface 24 and the midline latitudinal axis passing through the playing surface 24.

In order to use the beer pong table 10 of the present invention, a ball 42, which might be the same as or similar to a pool table ball, is provided and each of the two teams (teams being one or more players on each side without the need to have an identical number of players on each side) uses a cue 44, such as the illustrated pool cue 44. In turn, a player from one team shoots the ball 42 from their end of the game table 12 toward the opposing side of the game table 12. A foul line 46 can be imprinted on the playing surface 24 of the game table so that the shot must be taken behind the foul line 46. The player shoots the ball 42 using the cue 44 toward the opposing end, attempting to sink the ball into one of the openings 26 on the opposing end. If the player sinks the ball 42 into an opening 26, then a plug 34 is placed into that opening 26. Thereafter, whether the ball 42 is sunk into an opening 26 or not, a player on the opposing team shots the ball 42 back toward the first team's side of the game table 12, the opposing team likewise trying to sink the ball 42 into an opening 26 on the first team's side. This back-and-forth play continues until all the openings 26 on one side of the game table 12 are plugged so that the team that plugged all the openings 26 is the winner and receives whatever prize is at stake—of course beer or other refreshing adult beverage drinking can occur with each ball 42 sunk into an opening 26. Obviously, whenever a plug 34 is inserted into an opening 26, the handle 38 of that plug becomes an obstacle to sinking the ball 42 on the next shot toward that end of the game table 12 so that the shooter may need to bank their next shot off of the side wall 30. A rule variation may require a bank shot irrespective of whether any openings 26 are plugged. If the optional gutter 28 is used, banking on the end wall 32 is not possible.

Of course, many variations of game play are possible. The use of the cue 44 is not necessary and the players can simply launch the ball 42 with their hands. Additionally, a series of shot balls 48 can be provided with the main ball 42' being the shooting ball so that the game is played in pool table like fashion with the shooting ball 42' being shot toward the shot balls 48 so that an opening 26 is plugged with a plug 34 whenever a shot ball 48 lands in an opening 26. Appropriate rules can be established for a scratch, that is when the shot ball 42' lands in an opening 26 (or gutter 28). A rack 50 may be provided for racking the shot balls 48.

The game table 12 is made from an appropriate sturdy material, such as wood or plastic and the playing surface 24 may be of the same material or may be covered in felt or similar material.

While the beer pong table 10 is illustrated in a typical beer pong configuration, variations on opening geometry can be employed so that the openings may be arranged in other than a triangular pattern While the invention has been particularly shown and described with reference to an embodiment thereof, it will be appreciated by those skilled in the art that various changes in form and detail may be made without departing from the spirit and scope of the invention.

I claim:

1. A game system comprising:

a game table having a first end and an opposing second end joined by a first side and an opposing second side, the game table also having a playing surface, the playing surface of the game table bounded by a raised wall;

a series of first openings disposed within the playing surface proximate the first end;

a first gutter disposed within the playing surface between the first series of openings and the first end;

a series of second openings disposed within the playing surface proximate the second end;

a second gutter disposed within the playing surface between the second series of openings and the second end;

a series of plugs such that each plug is receivable within a respective one of the first openings or second openings; and a first ball that is rolled upon the playing surface, the ball dimensioned to fit within each of the first openings, each of the second openings, the first gutter, and the second gutter.

2. The game system as in claim 1 wherein the series of first openings is arranged in a triangular pattern and each of the second openings is arranged in the triangular pattern.

3. The game system as in claim 2 wherein the playing surface is symmetrical about the midline longitudinal axis passing through the playing surface and the playing surface is symmetrical about the midline latitudinal axis passing through the playing surface.

4. The game system as in claim 1 wherein the playing surface is symmetrical about the midline longitudinal axis passing through the playing surface and the playing surface is symmetrical about the midline latitudinal axis passing through the playing surface.

5. The game system as in claim 1 wherein each plug comprises a base that is received within the respective first opening or second opening that receives the plug and a handle that extends above the playing surface whenever the plug is received within the respective first opening or second opening.

6. The game system as in claim 1 in combination with a cue wherein the cue is used to propel the first ball.

7. The game system as in claim 1 further comprising a series of second balls that roll upon the playing surface, being propelled by being struck by the first ball.

8. The game system as claim 7 in combination with a rack for racking the second balls upon the playing surface.

9. A game system comprising:

a game table having a first end and an opposing second end joined by a first side and an opposing second side, the game table also having a playing surface, the playing surface of the game table bounded by a raised wall;

a series of first openings disposed within the playing surface proximate the first end, the series of first openings arranged in a triangular pattern;

a first gutter disposed within the playing surface between the first series of openings and the first end;

a series of second openings disposed within the playing surface proximate the second end, the second openings arranged in the triangular pattern;

a second gutter disposed within the playing surface between the second series of openings and the second end;

a series of plugs such that each plug is receivable within a respective one of the first openings or second openings, each plug comprising a base that is received within the respective first opening or second opening and a handle that extends above the playing surface whenever the plug is received within the respective first opening or second opening;

a first ball that is rolled upon the playing surface, the ball dimensioned to fit within each of the first openings, each of the second openings, the first gutter, and the second gutter; and wherein the playing surface is symmetrical about the midline longitudinal axis passing through the playing surface and the playing surface is symmetrical about the midline latitudinal axis passing through the playing surface.

10. The game system as in claim 9 in combination with a cue wherein the cue is used to propel the first ball.

11. The game system as in claim 9 further comprises a series of second balls that roll upon the playing surface, being propelled by being struck by the first ball.

12. The game system as claim 11 in combination with a rack for racking the second balls upon the playing surface.

* * * * *